US005683125A

United States Patent [19]

Tseng

[11] Patent Number: 5,683,125

[45] Date of Patent: Nov. 4, 1997

[54] SINGLE-HANDLE INSIDE ACTUATOR FOR MOTOR-VEHICLE DOOR LATCH

[75] Inventor: Teru Tseng, Troy, Mich.

[73] Assignee: Kiekert AG, Heiligenhaus, Germany

[21] Appl. No.: 709,095

[22] Filed: Sep. 6, 1996

[30] Foreign Application Priority Data

Sep. 8, 1995 [DE] Germany ..... 195 33 198.2

[51] Int. Cl.[6] ..... E05C 3/06

[52] U.S. Cl. ..... 292/216; 292/336.3; 292/DIG. 23; 292/DIG. 27

[58] Field of Search ..... 292/216, DIG. 23, 292/DIG. 27, 336.3

[56] References Cited

U.S. PATENT DOCUMENTS 4,974,886 12/1990 Kleefeldt et al. ..... 292/216
5,419,597 5/1995 Brackmann et al. ..... 292/216

FOREIGN PATENT DOCUMENTS 0 475 037 3/1992 European Pat. Off. .
44 33 994 3/1996 Germany .

*Primary Examiner*—Steven N. Meyers

*Assistant Examiner*—Stephen J. Pentlicki

*Attorney, Agent, or Firm*—Herbert Dubno; Andrew Wilford

[57] ABSTRACT

A motor-vehicle door latch has a latching fork and a release pawl engageable with the fork and pivotal between a latched position retaining the fork and an unlatched position. An inside door handle displaceable between a center rest position, an end open position, and an end locked position is connected to one end of the core of a bowden cable having a sheath fixed to the housing. A first actuating lever pivotal about an axis offset from the locking-lever axis has an arm and is connected to the other end of the cable core for joint movement of the first actuating lever with the inside handle. A second actuating lever pivotal between an actuated and an unactuated position has a formation engageable with the first actuating lever. A first locking lever pivotal about an axis fixed offset from the axis of the first actuating lever between a locked position and an unlocked position is formed with a cutout in which is engaged the arm of the first actuating lever in the rest and locked positions of the inside handle. A second locking lever pivotal also between a locked and unlocked position is permanently coupled to the first locking lever for synchronous movement therewith. The pawl is displaced into the unlatched position on displacement of the second actuating lever into the actuated position and is decoupled from the second locking lever in the locked positions of the locking levers.

6 Claims, 5 Drawing Sheets

SINGLE-HANDLE INSIDE ACTUATOR FOR MOTOR-VEHICLE DOOR LATCH

FIELD OF THE INVENTION

The present invention relates to a motor-vehicle door latch. More particularly this invention concerns an inside single-handle actuating assembly for such a door latch.

BACKGROUND OF THE INVENTION

A standard motor-vehicle door latch has a housing, a latching fork pivotal on the housing, and a release pawl engageable with the fork and pivotal on the housing between a latched position retaining the fork in a latched position engaged around a bolt and securing a motor-vehicle door closed and an unlatched position in which the fork can release the bolt and allow the door to open. In a single-handle system such as described in commonly owned application Ser. No. 08/652,246 filed 23 May 1996 there is an inside door handle displaceable between a center rest position, an end open position, and an end locked position and a bowden cable having a sheath fixed to the housing and a core having a pair of ends one of which is attached to the handle for displacement of another end of the core jointly with the door handle.

The latch further has, as described in European patent 0,475,037 of H. Kaiser and based on a German application filed 8 Aug. 1980, a first actuating lever pivotal on the housing and connected to the other end of the cable core for joint movement of the first actuating lever with the inside handle. A second actuating lever pivotal on the housing between an actuated and an unactuated position has a formation engageable with the first actuating lever. A first locking lever is pivotal coaxially with the first actuating lever between a locked position and an unlocked position and is coupled to the first actuating lever for movement jointly therewith between the positions corresponding to the locked and rest positions of the inside handle. A second locking lever is pivotal on the housing also between a locked and unlocked position and is permanently coupled to the first locking lever for synchronous movement therewith, Mechanism between the second actuating lever and the pawl displaces the pawl into the unlatched position on displacement of the second actuating lever into the actuated position but decouples the second actuating lever from the pawl in the locked positions of the locking levers.

Such a system is relatively effective but the assembly formed by the first actuating lever and the first locking lever is rather bulky. Since it must be accommodated in the vehicle door between the region occupied by the window glass with the window open and the inside door panel, the door must frequently be made thicker than otherwise necessary to accommodate this structure.

OBJECTS OF THE INVENTION

It is therefore an object of the present invention to provide an improved motor-vehicle door latch.

Another object is the provision of such an improved motor-vehicle door latch which overcomes the above-given disadvantages, that is whose actuation assembly is substantially more compact.

SUMMARY OF THE INVENTION

A motor-vehicle door latch has according to the invention a housing, a latching fork pivotal on the housing, and a release pawl engageable with the fork and pivotal on the housing between a latched position retaining the fork in a latched position engaged around a bolt and securing a motor-vehicle door closed and an unlatched position in which the fork can release the bolt and allow the door to open. An inside door handle displaceable between a center rest position, an end open position, and an end locked position is connected to one end of the core of a bowden cable having a sheath fixed to the housing. A first actuating lever pivotal on the housing has an arm and is connected to the other end of the cable core for joint movement of the first actuating lever with the inside handle. A second actuating lever pivotal on the housing between an actuated and an unactuated position has a formation engageable with the first actuating lever. A first locking lever pivotal about an axis fixed on the housing offset from the axis of the first actuating lever between a locked position and an unlocked position is formed with a cutout in which is engaged the arm of the first actuating lever in the rest and locked positions of the inside handle. A leaf spring on the first locking lever engaging the arm of the first actuating lever permits the arm of the first actuating lever to move out of the cutout on displacement of the handle into its end open position. A second locking lever pivotal on the housing also between a locked and unlocked position is permanently coupled to the first locking lever for synchronous movement therewith. Mechanism between the second actuating lever and the pawl displaces the pawl into the unlatched position on displacement of the second actuating lever into the actuated position and decouples the second actuating lever from the pawl in the locked positions of the locking levers.

Thus with this system the first actuating lever and first locking lever can both be flat and substantially coplanar. Thus they can easily be accommodated in the vehicle door, providing single-handle actuation and locking of the door in a very compact mechanism.

The mechanism according to the invention includes a coupling lever engaged between the second locking lever and the pawl and coaxially pivoted with the second locking lever and a spring pressing the coupling lever against the second locking lever. In addition an outside actuating lever is couplable to the second actuating lever in the unlocked position of the locking levers.

The mechanism further includes an outside locking lever coupled to the transmission lever and with an L-shaped opening. The second actuating lever is formed with an elongated slot aligned with the opening. The mechanism has a pin projecting through the slot and opening and a control edge for releasing the release pawl. The release pawl has a pin engageable with the control edge in the unlocked position and unengageable therewith in the locked position of the locking levers. A central locking element is displaceable adjacent the second locking lever and a releasable coupling is engaged between the central locking element and the second locking lever.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
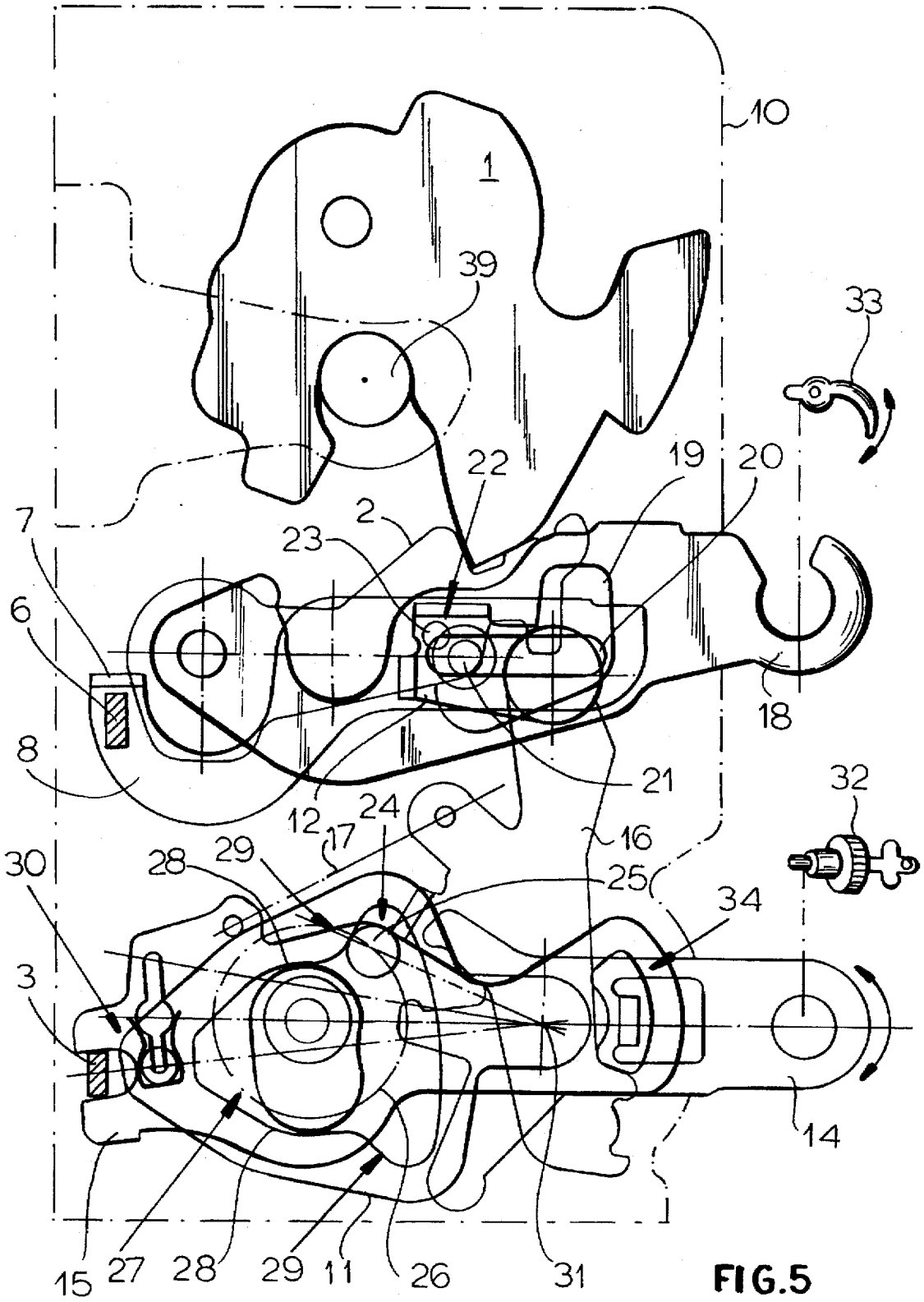
FIG. 5 is a partly diagrammatic view illustrating the mechanism of the latch.

As seen in FIG. 5 a door latch of the type generally described in copending application Ser. No. 08/503,404 filed 17 Jul. 1996 has a pivotal fork 1, a release pawl 2, and a release lever 12 both pivoted on a housing 10 to hold and retain a bolt 39 mounted on a door post. In addition it is provided with an actuating-lever system and a locking-lever system. The actuating-lever system more particularly has an inside actuating lever 8 and an outside actuating lever 18 operated by an outside handle 33. The locking-lever system has an inside locking lever 15 that can be actuated by a lever 3 as well as an outside locking lever 14 operated by an outside locking cylinder 32. The outside locking lever 14 as well as the inside locking lever 15 are pivotal about a common axis 31 and a lost-motion coupling 34 connects the levers 14 and 15. Also mounted on the pivot axis 31 is a coupling lever 16 which connects the locking lever system with the actuating lever system. The coupling lever 16 is connected via a spring element 17 with the inside locking lever 15. This force-transmitting connection via the spring element 17 is set up such that the motor-vehicle door latch can be locked even if the outside actuating lever 18 and/or the inside actuating lever 8 are in the locked positions.

The release lever 12 is pivoted on the coupling lever 16. The outside actuating lever 18 has a generally L-shaped cutout 19 and the inside actuating lever 4 has a longitudinally extending slot 20. The release lever 12 is provided with a guide pin 21 projecting through both the L-shaped cutout 19 and the slot 20. A cam edge 22 on the release lever 12 serves for releasing the release pawl 2. The cam edge 22 stays in the unlocked position of the coupling lever 16 in operative engagement with a release pin 23 of the pawl 2. On the other hand the cam edge 22 in the unlocked position of the coupling lever 16 is clear of the pin 23 of the pawl 2. In this manner the outside actuating lever 18 is disconnected in the locked position of the coupling lever 16, that is its actuation does not move the pawl 2.

The motor-vehicle door latch shown in FIG. 5 is further equipped with a central locking drive as well as with a central-locking element 11 connected to the locking lever system. The central locking drive is constituted as a reversible electric-motor drive which has an output element 24 with an eccentric control pin 25. The control pin 25 is movable along an orbit 26 left and right to displace the central locking element 11 between the unlocked and locked positions. The central-locking element 11 has in particular a cutout 27 with lateral control surfaces 28 directed into the cutout 27 and confronting the control pin 25. The inside locking lever 15 and the central locking element 11 are connected to each other physically via an emergency unlocking connecting element 30 constituted as a spring clip on the element 11 and a pin on the lever 15. A part of the orbit 26 of the control pin 25 lies outside the cutout 27 of the central-locking element 11. The central-locking element 11 has to each side of the cutout 27 a respective abutment surface 29 for the control pin 25. The positions of the control pin 25 are limited by running up of the control pin 25 against one of the abutment surfaces 29 whereupon the electric-motor drive is cut off. This can be done by position-detecting switches and also by monitoring the increased current consumption of the motor when the pin 25 engages 15 one of the abutments 29. The inside-locking lever 15 is also pivotal about the axis 31. The cutout 27 of the central locking element 11 is open radially inwardly relative to the axis 31.

The emergency-unlocking/connecting element 30 is formed as a force-transmitting snap connection so that the connection between the inside-locking lever 15 and the central-locking element 11 is releasable only toward the unlocked position of the inside locking lever 15. The inside-locking lever 15 and the central-locking element 11 under normal conditions, that is with no out-of the ordinary outside influences, act like a single 25 part. In the case of an accidental blocking of the locked position of the central-locking element 11 it is still possible to effect an emergency unlocking. A sufficiently strong actuation of the inside-locking lever 15 will disconnect the emergency-unlocking/connecting element 13 and will unlock the motor-vehicle door latch even if the central-locking element 11 is set in the locked position. A strong subsequent actuation of the inside-locking lever 15 into the locked position again connects up the emergency element 30. After restoration of the functionality of the motor drive (for example by charging of the vehicle's battery) the motor-vehicle door latch according to the invention is thus once again operational.

Figure 1:
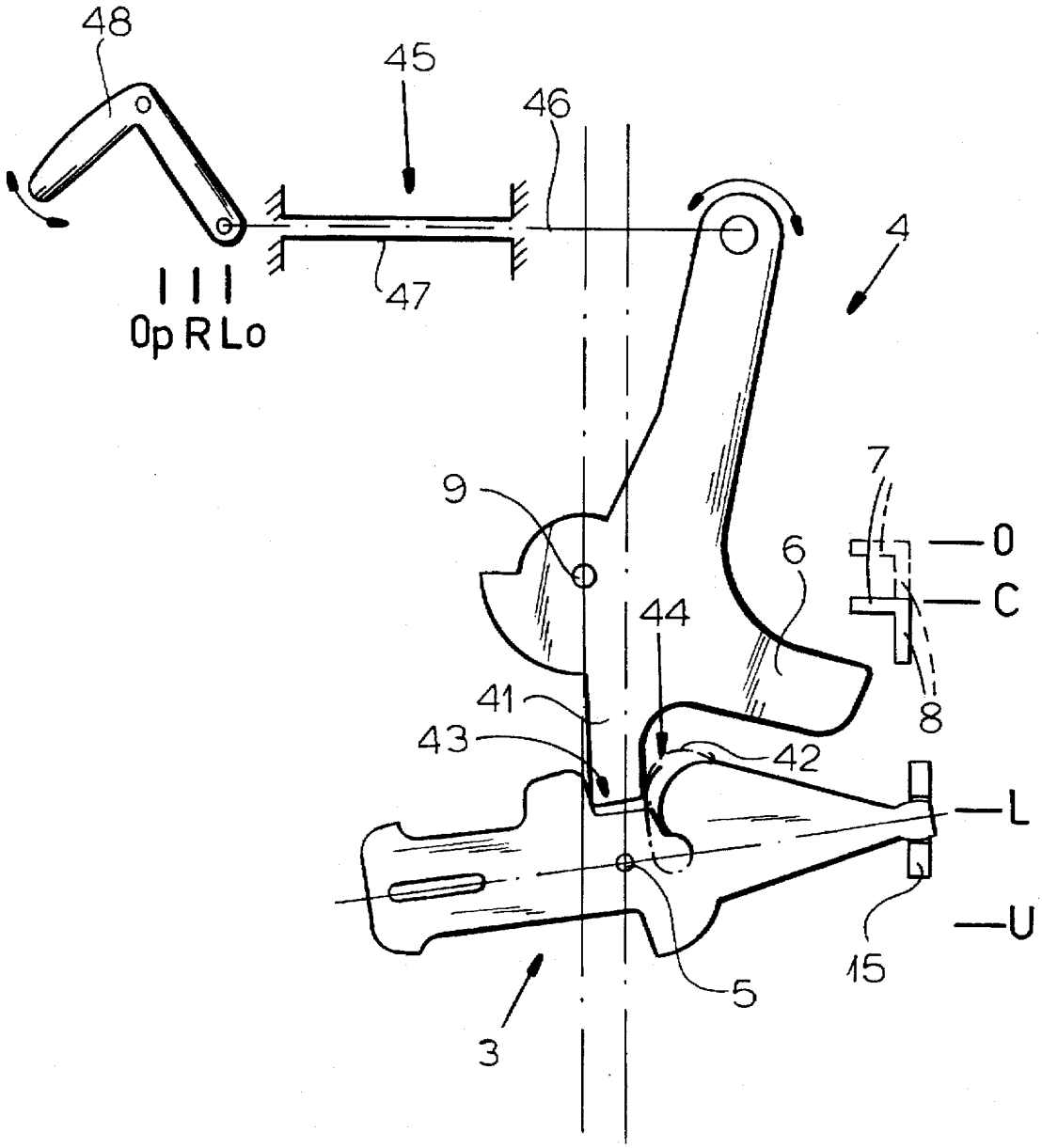
FIG. 1 is a partly diagrammatic view of the actuating assembly of the latch according to the invention in the locked position.
Figure 2:
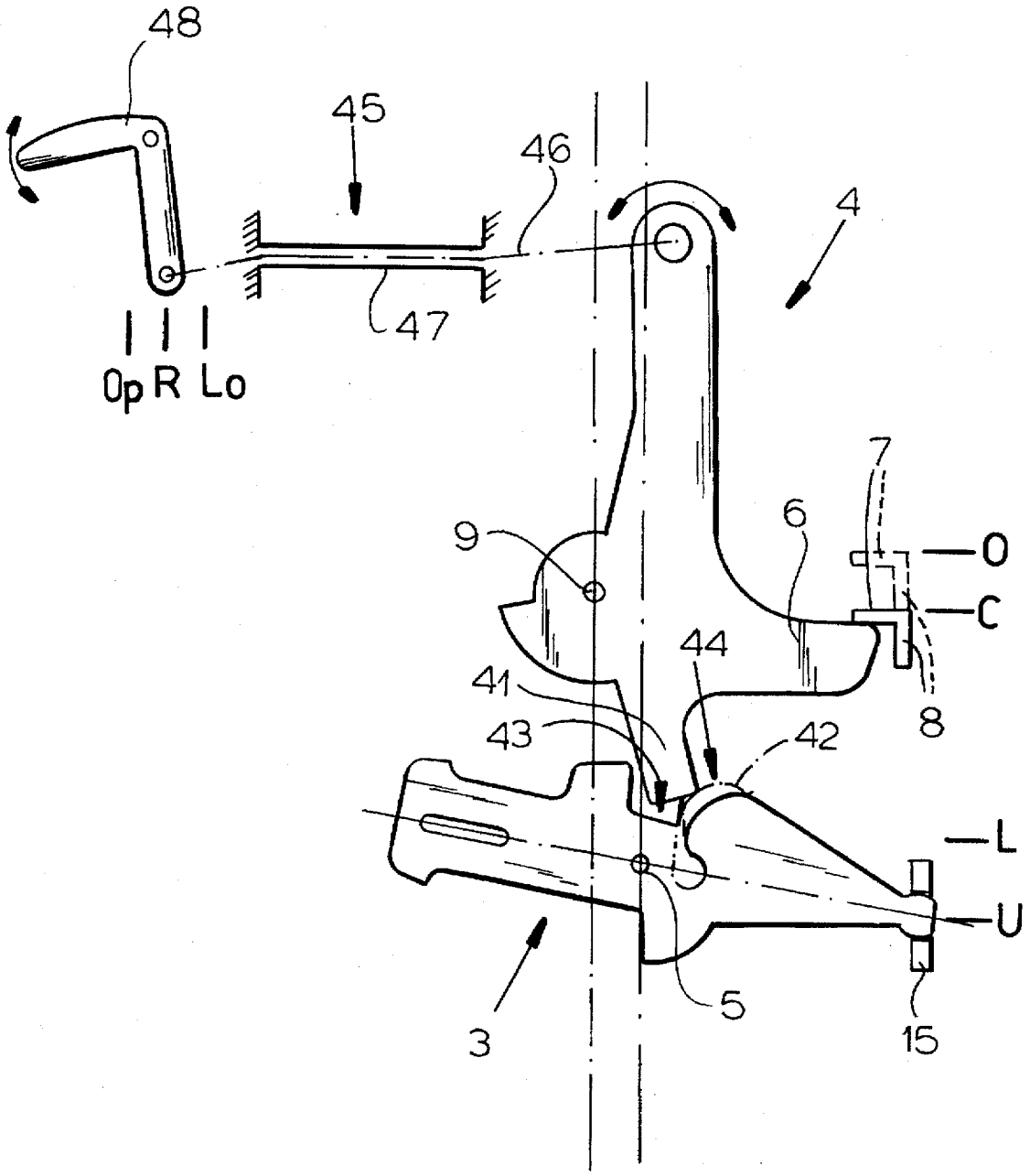
FIGS. 2 and 3 are views like FIG. 1 but with the assembly in the unlocked and actuated positions, respectively.
Figure 3:
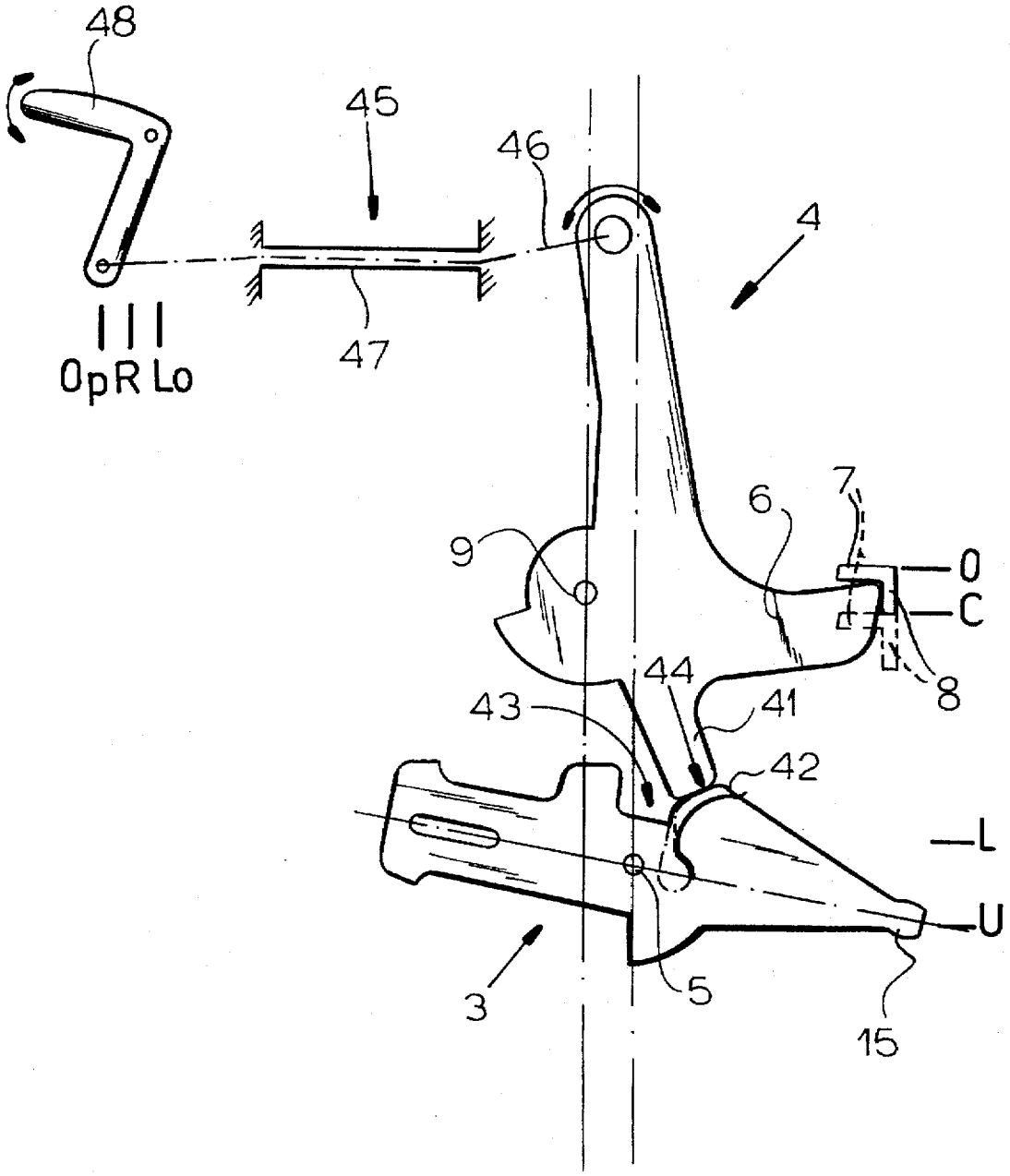

As better seen in FIGS. 1 through 4, an inside handle 48 is attached to a core 46 of a bowden cable 45 whose sleeve 47 is fixed on the housing 10 or vehicle body. The other end of the core 46 is connected to a first actuating lever 4 pivoted at 9 on the housing 10 or a related door part and having one arm 6 engageable under a bent-out tab 7 of the second actuating lever 8. Thus when pivoted counterclockwise as indicated in FIGS. 2 and 3 the arm 6 engages under and raises the end of the lever 8, moving it from a closed position C to an open position O.

The lever 4 also has an arm 41 engaged in a notch 43 of the inside or first locking lever 3 which is pivoted at an axis 5 offset from but parallel to the axis 9 on the housing 1 or door. The two levers 3 and 4 are substantially flat and coplanar so that they can be accommodated easily in the vehicle door between the glass and the inside panel. An end of the lever 3 is fitted in a cutout of the second locking lever 15 and moves to displace same between a locked position L and an unlocked position U.

Figure 4:
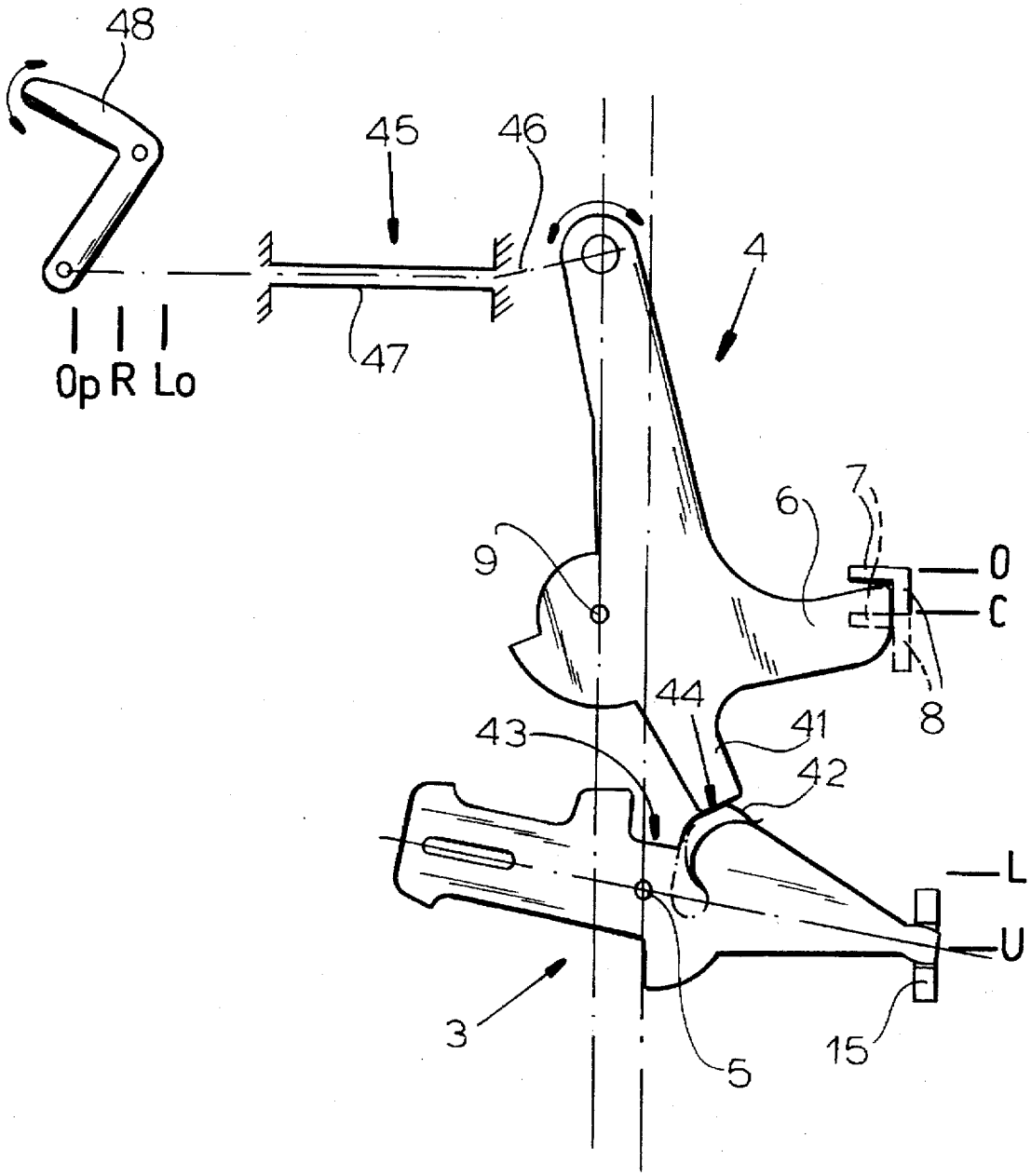
FIG. 4 is a view like FIG. 1 showing an overactuated position of the inside door handle.

The notch 43 is provided on one side with a leaf spring 42 that normally grips the arm 41 and holds it in the notch 43 as the handle 48 is moved between an end locked position Lo (FIG. 1) and a central rest position R (FIG. 2), for synchronous movement of the lever 15 between its unlocked and locked positions U and L. When, however, the handle 48 is moved from its central rest position R (FIG. 2) in the opposite direction to its open position Op, the arm 41 comes out of the cutout 43 without angular movement of the levers 3 and 15 while the arm 6 engages and raises the actuating lever 8 from the closed position C to the open position 0, with sliding of the arm 41 on a long leg 44 of the spring 43. If the handle is pushed even further from position OP, no harm is done as shown in FIG. 4.

Thus if the handle 48 is pushed in one direction the door is locked, and if pushed in the opposite direction it is opened and, if necessary, also unlocked.

An antitheft mechanism can be provided which blocks the coupling lever 16 in the right-hand decoupled position in which the latch cannot be opened from inside or out.

I claim:

1. A motor-vehicle door latch comprising:

a housing;

a latching fork pivotal on the housing;

a release pawl engageable with the fork and pivotal on the housing between a latched position retaining the fork in a latched position engaged around a bolt and securing a motor-vehicle door closed and an unlatched position in which the fork can release the bolt and the door to open;

an inside door handle displaceable between a center rest position, an end open position, and an end locked position;

a bowden cable having a sheath fixed to the housing and a core having a pair of ends one of which is attached to the handle for displacement of another end of the core jointly with the door handle;

a first actuating lever pivotal on the housing about an axis, having an arm, and connected to the other end of the cable core for joint movement of the first actuating lever with the inside handle;

a second actuating lever pivotal on the housing between an actuated and an unactuated position and having a formation engageable with the first actuating lever;

a first locking lever pivotal about an axis fixed on the housing offset from the axis of the first actuating lever between a locked position and an unlocked position and formed with a cutout in which is engaged the arm of the first actuating lever in the rest and locked positions of the inside handle;

means including a leaf spring on the first locking lever engaging the arm of the first actuating lever for permitting the arm of the first actuating lever to move out of the cutout on displacement of the handle into its end open position;

a second locking lever pivotal on the housing also between a locked and unlocked position and permanently coupled to the first locking lever for synchronous movement therewith; and mechanism between the second actuating lever and the pawl for displacing the pawl into the unlatched position on displacement of the second actuating lever into the actuated position and for decoupling the second actuating lever from the pawl in the locked positions of the locking levers.

2. The motor-vehicle door latch defined in claim 1 wherein the mechanism includes:

a coupling lever engaged between the second locking lever and the pawl and coaxially pivoted with the second locking lever, and a spring pressing the coupling lever against the second locking lever.

3. The motor-vehicle door latch defined in claim 2, further comprising:

an outside actuating lever couplable to the second actuating lever in the unlocked position of the locking levers.

4. The motor-vehicle door latch defined in claim 3 wherein the mechanism includes:

an outside locking lever coupled to the transmission lever and with an L-shaped opening, the second actuating lever being formed with an elongated slot aligned with the opening, the mechanism having a pin projecting through the slot and opening; and a control edge for releasing the release pawl, the release pawl having a pin engageable with the control edge in the unlocked position and unengageable therewith in the locked position of the locking levers.

5. The motor-vehicle door latch defined in claim 4, further comprising:

a central locking element displaceable adjacent the second locking lever; and a releasable coupling engaged between the central locking element and the second locking lever.

6. The motor-vehicle door latch defined in claim 1 wherein the first actuating lever and the first locking lever are each flat and are substantially coplanar.

* * * * *